United States Patent [19]

Hough

[11] Patent Number: 4,714,406

[45] Date of Patent: Dec. 22, 1987

[54] TURBINES

[75] Inventor: Geoffrey S. Hough, Littleover, England

[73] Assignee: Rolls-Royce plc, London, England

[21] Appl. No.: 65,139

[22] Filed: Jun. 25, 1987

Related U.S. Application Data

[63] Continuation of Ser. No. 848,345, Apr. 4, 1986, abandoned, which is a continuation of Ser. No. 630,237, Jul. 12, 1984, abandoned.

[30] Foreign Application Priority Data

Sep. 14, 1983 [GB] United Kingdom ..... 8324670

[51] Int. Cl.[4] ..... F01D 11/08

[52] U.S. Cl. ..... 415/170 R; 415/175; 415/DIG. 1

[58] Field of Search ..... 415/DIG. 1, 170 B, 170 R, 415/116, 176, 117, 174, 196, 197, 172 A, 173 A, 219 R

[56] References Cited

U.S. PATENT DOCUMENTS

| | | | |
|---|---|---|---|
| 3,365,172 | 1/1968 | McDonough et al. | 415/DIG. 1 |
| 4,466,772 | 8/1984 | Okapuu et al. | 415/170 R |

FOREIGN PATENT DOCUMENTS

| | | | |
|---|---|---|---|
| 0016105 | 2/1978 | Japan | 415/DIG. 1 |
| 0013004 | 11/1906 | United Kingdom | 415/170 R |
| 289821 | 11/1928 | United Kingdom . | |
| 1364511 | 8/1974 | United Kingdom . | |
| 1423833 | 2/1976 | United Kingdom . | |
| 2017228 | 10/1979 | United Kingdom | 415/170 R |
| 2034435 | 6/1980 | United Kingdom | 415/DIG. 1 |
| 2110767 | 6/1983 | United Kingdom . | |

*Primary Examiner*—Robert E. Garrett
*Assistant Examiner*—Joseph M. Pitko
*Attorney, Agent, or Firm*—Cushman, Darby & Cushman

[57] ABSTRACT

A turbine provided with at least an annular array of rotary aerofoil blades has a casing, the radially inwardly facing surface of which is provided with a plurality of grooves. The grooves are adjacent the radially outer tips of the aerofoil blades and are so arranged that they direct the gas flow between the blade tips and the casing along the absolute ideal flow path in the region of the blade tips. This ensures that at least some of the momentum of the gases flowing between the blade tips and the casing is transformed into rotating energy as vortices form in the grooves. This energy is subsequently imparted to the tips of the aerofoil blades.

4 Claims, 4 Drawing Figures

TURBINES

This is continuation of application Ser. No. 848,345, filed Apr. 4, 1986, now abandoned, which is a continuation of application Ser. No. 630,237, filed July 12, 1984, now abandoned.

This invention relates to turbines.

Turbines conventionally comprise one or more stages of annular arrays of rotary aerofoil blades which are enclosed within an annular gas passage, the radially outer extent of which is partially defined by the outer casing of the turbine or alternatively by a shroud ring which is attached to the casing. The tips of the rotary aerofoil blades are arranged to pass as closely as possible to the casing or shroud ring in order to minimise the leakage of gases passing through the turbine across the gap between the blade tips and the casing or shroud ring. However if the blade tip clearances are reduced by too great an amount, there is a danger that contact will occur between the blade tips and the casing or shroud ring. Consequently it is accepted that the tip clearances must be of such a value that leakage occurs in order to avoid the danger of blade tip/casing contact.

It is an object of the present invention to provide a turbine in which the efficiency loss as a result of gas leakage across the gap between the blade tips and turbine casing or shroud ring is reduced.

According to the present invention, a turbine comprises at least one annular array of rotary aerofoil blades enclosed within an annular gas passage, the axes of said array of aerofoil blades and said gas passage being coaxial, and an annular member surrounding at least the radially outer tips of said aerofoil blades, said annular member having a radially inwardly facing surface which is in radially spaced apart relationship with said aerofoil blade tips and also defines the radially outer boundary of at least a portion of the axial extent of said annular gas passage, the portion of said radially inner surface which is adjacent said blade tips being provided with a plurality of gas flow directing means which are so configured that any gas passing in operation through said turbine which flows across the gap between said annular member and said blade tips is directed by said flow directing means to substantially follow the absolute ideal flow path for gases in the region of said aerofoil blade tips.

To a person skilled in the art, the term "absolute ideal flow path" refers to the average streamline path relative to a static turbine outer casing which would be followed by inviscid compressible turbine gases passing through the tip passage of a rotating turbine rotor blade cascade given zero over-tip leakage.

The invention will now be described, by way of example, with reference to the accompanying drawings in which.

Figure 1:
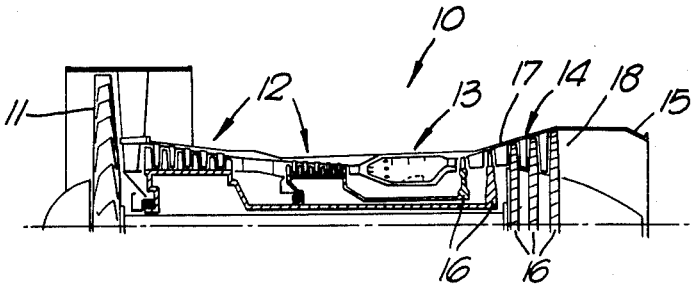
FIG. 1 is a sectional side view of a gas turbine engine which incorporates a turbine in accordance with the present invention.

With reference to FIG. 1, a ducted fan gas turbine engine generally indicated at 10, comprises, in axial flow series, a ducted fan 11, a compressor 12, combustion equipment 13, a turbine 14 and a propulsion nozzle 15. The engine 10 functions in the conventional manner, that is, air which is compressed by the fan 11 is divided into two portions, the first is directed into the compressor 12 and the second directed to atmosphere to provide propulsive thrust. The air which is directed into the compressor 12 is compressed further before being mixed with fuel and the mixture combusted in the combustion equipment 13. The combustion products expand through the turbine 14 and are exhausted to atmosphere through the propulsion nozzle 15. Various portions of the turbine 14 are drivingly interconnected with the compressor 12 and the fan 11.

The turbine 14 comprises five annular arrays 16 of rotary aerofoil blades which are enclosed within the turbine casing 17. The aerofoil blades 19 on the arrays 16 are positioned in the annular gas passage 18 which extends through the turbine 14 so that the axes of the aerofoil blade arrays 16 and the central axis of the annular gas passage 18 are coaxial.

Figure 2:
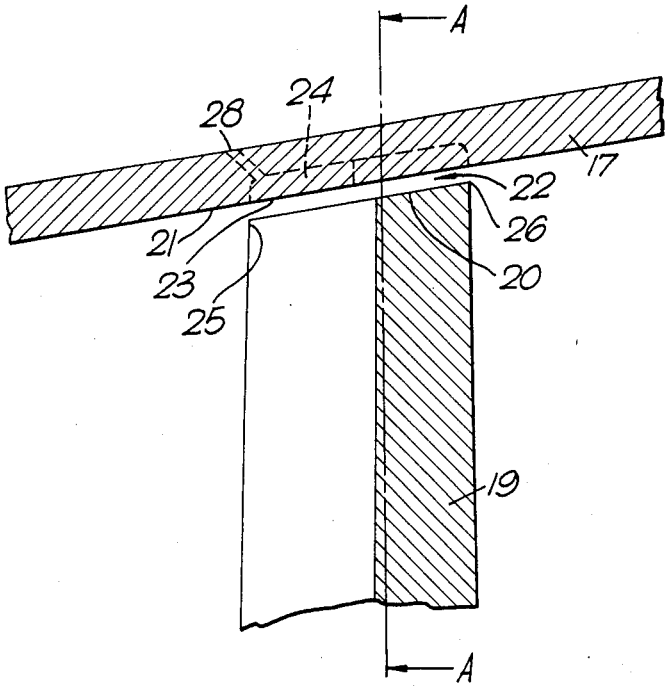
FIG. 2 is an enlarged sectional side view of a portion of the turbine of the gas turbine engine shown in FIG. 1.

A portion of one of the aerofoil blades 19 on one of the annular arrays 16 and the portion of turbine casing 17 which surrounds it can be seen more clearly in FIG. 2. The tip 20 of the aerofoil blade 19 is radially spaced apart from the radially inwardly facing surface 21 of the turbine casing 17 so that a gap 22 is defined between them. This gap 22 is of such a magnitude that under all normal turbine operating conditions, the thermal expansion and contraction of the casing 17 and the annular rotary aerofoil blade arrays 16 is insufficient to result in the blade tips 20 making contact with the radially inwardly facing surface 21 of the turbine casing 17.

Figure 3:
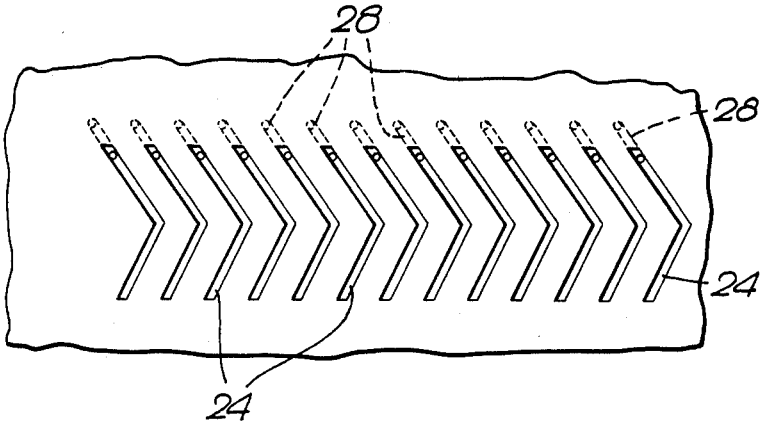
FIG. 3 is a developed plan view of the radially inner surface of the casing of the turbine portion shown in FIG. 2.

That portion 23 of the radially inwardly facing surface 21 of the turbine casing 17 which is immediately adjacent the aerofoil blade tips 20 is provided with a series of grooves 24 which can be seen more easily in FIG. 3. The grooves 24 extend from the leading edge region 25 of the aerofoil blade tips 20 to the trailing edge region 26 and are so configured that they are generally aligned with the absolute ideal flow path of turbine gases in the region of the blade tips 20. In the particular configuration shown in FIG. 3 the grooves 24 define a chevron-type pattern. However, it will be appreciated that the particular configuration of the grooves 24 is governed solely by the absolute ideal flow path in the region of the blade tips 20 and that other turbines with different absolute ideal flow paths over their blade tips 20 will have correspondingly different configurations of their grooves 24. It will also be appreciated that manufacturing difficulties may dictate that the configuration of each groove 24 does not exactly follow the absolute ideal flow path in the region of the blade tips 20 but that it only substantially follows the absolute ideal flow path.

Figure 4:
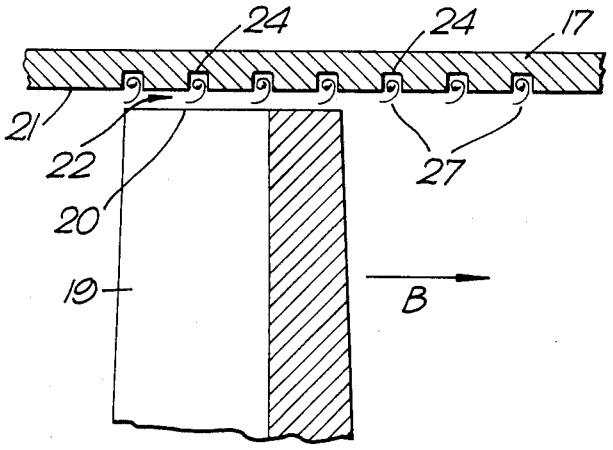
FIG. 4 is a view in section line A—A of FIG. 2, the arrow B indicating the direction of rotation of the aerofoil blades of the turbine.

The grooves 24 provide a preferential flow path for turbine gases passing through the gap 22 between the blade tips 20 and the casing 17. Vortices 27 of the turbine gases are trapped in the grooves 24 can be seen in FIG. 4. Their direction of rotation follows the natural right hand rule for the conservation of vorticity (Kelvins theorem). Consequently turbine gas flow in the region of the radially inner surface 21 of the turbine casing 17 has initial boundary layer vorticity which, when rotated in the plane of the casing 17 tends to "roll-up" as indicated. Thus in re-directing the boundary layer gas flow along the absolute ideal flow path, its momentum is transformed into rotating energy in the vortices 27 which energy is subsequently imparted to the tips 20 of the blades 19. It will be seen therefore that the momentum of the turbine gas flow through the gap 22 between the turbine casing 17 and the blade tips 20 is not wasted as would normally be the case but is used to impart energy to the rotary aerofoil blades 19. Consequently although there is a leakage of turbine gases through the gap 22, the efficiency loss of the turbine 14 as a result of that leakage is reduced.

The gases which, in operation flow through the turbine 14 are usually very hot and consequently it is possible that the vortices 27 could cause some localised overheating of the turbine casing 17. In such a situation, cooling of the grooves 24 could be achieved by the provision of cooling passages 28 in the casing 17 as can be seen in FIGS. 2 and 3. Each passage 28 interconnects each groove 24 with the exterior of the turbine casing 17. A suitable flow of cooling air derived from the compressor 12 of the engine 10 is supplied to the exterior of the turbine casing 17 (by means not shown) in order to provide a supply of cooling air for the grooves 24.

Although the present invention has been described with reference to grooves 24 which are provided in the radially inner surface 21 of the turbine casing 17, it will be appreciated that they could be equally effectively be provided in a shroud ring. Such a shroud ring would be attached to the turbine casing 17 and surround one stage 16 of rotary aerofoil blades. If it was found to be difficult to provide cooling passages in such a shroud ring, the shroud ring could be made from a suitable ceramic material which would be capable of resisting the high temperatures of the gases passing through the turbine 14.

I claim:

1. A turbine comprising:

at least one annular array of rotary aerofoil blades having radially outer tips;

an annular gas passage, said annular array of rotary aerofoil blades being enclosed within said annular gas passage so that the axes of said array of aerofoil blades and said gas passage are coaxial; and an annular member surrounding at least said radially outer tips of said aerofoil blades and having a radially inner surface which is in radially spaced apart relationship with said aerofoil blade tips, said annular member defining the radially outer boundary of at least a portion of the axial extent of said annular gas passage;

means in the portion of said radially inner surface which is adjacent said blade tips for directing the flow of any gas passing in operation through said turbine which flows across the gap between said annular member and said blade tips as a boundary layer having a vorticity and defining a leakage to substantially follow an absolute ideal flow path for gases in the region of said aerofoil blade tips, said gas directing means imparting energy of the vortices to said blade tips with a reduction in loss of efficiency despite leakage of gases through said gap;

said gas directing means comprising a plurality of grooves spaced peripherally about said annular member with each groove being in the form of two slots which intersect at an angle to form a chevron.

2. A turbine as claimed in claim 1 wherein said gas flow directing means is constituted by a plurality of grooves in the radially inwardly facing surface of said annular member, said grooves being substantially aligned with the absolute ideal flow path for gases in the region of said aerofoil blade tips.

3. A turbine as claimed in claim 1 wherein said annular member is constituted by the casing of said turbine.

4. A turbine as claimed in claim 1 wherein said grooves are cooled by a flow of cooling fluid.

* * * * *